US005516094A

United States Patent [19]

Sander

[11] Patent Number: 5,516,094

[45] Date of Patent: May 14, 1996

[54] LINEAR ARRAY SENSOR FOR COPY SHEET REGISTRATION

[75] Inventor: Charles F. Sander, Penfield, N.Y.

[73] Assignee: Xerox Corporation, Stamford, Conn.

[21] Appl. No.: 265,171

[22] Filed: Jun. 24, 1994

[51] Int. Cl.[6] ..... B65H 7/02

[52] U.S. Cl. ..... 271/259; 250/223 R; 340/675

[58] Field of Search ..... 340/674, 675; 250/561, 571, 221.1, 223 R; 271/258.01, 259, 265.01, 265.02

[56] References Cited

U.S. PATENT DOCUMENTS

| | | | |
|---|---|---|---|
| T858,020 | 1/1969 | Leana | 250/223 R |
| 4,077,620 | 3/1978 | Frank et al. | 271/265 |
| 4,475,156 | 10/1984 | Federico et al. | 364/300 |
| 4,691,912 | 9/1987 | Gillmann | 271/265 X |
| 4,874,958 | 10/1989 | Sampath et al. | 355/309 |
| 5,321,255 | 6/1994 | Kakinami et al. | 250/561 X |

*Primary Examiner*—William E. Terrell
*Assistant Examiner*—Tamara Kelly
*Attorney, Agent, or Firm*—H. Fleisher; J. E. Beck; R. Zibelli

[57] ABSTRACT

An electrophotographic printing machine of the type in which a leading edge and a trailing edge of a moving sheet are detected. The improvement includes an elongated light source that is of a length greater than that of an irregularity on the moving sheet. The elongated light source extends in a direction substantially parallel to the direction of the moving sheet. A plurality of sensors are arranged in an array and are movably mounted on a support which is extended in a direction substantially parallel to the elongated light source. The elongated light source is movably mounted to another support, so as to position the light source relative to the array of sensors. A lens, interposed between the light source and the sensor array focuses light rays emitted from the light source on to the sensors. The sensors are in a receiving relationship with the light source. The elongated light source and the array of sensors define a passageway through which the moving sheet passes.

12 Claims, 7 Drawing Sheets

LINEAR ARRAY SENSOR FOR COPY SHEET REGISTRATION

The present invention relates generally to an electrophotographic printing machine, and more particularly concerns an apparatus for detecting a lead edge and a trail edge of a copy sheet.

In a typical electrophotographic printing, a photoconductive member is charged to a substantially uniform potential so as to sensitize the surface thereof. The charged portion of the photoconductive member is exposed to a light image of an original document being reproduced. Exposure of the charged photoconductive surface selectively dissipates the charge thereon in the irradiated areas. This records an electrostatic latent image on the photoconductive member corresponding to the informational areas contained within the original document. After the electrostatic latent image is recorded on the photoconductive surface, a latent image is developed by bringing developer materials into contact therewith. Generally, the developer material comprises toner particles adhering triboelectrically to carrier granules. Toner particles are attracted from the carrier granules to the latent image forming a toner powder image on the photoconductive surface. The toner powder image is then transferred from the photoconductive surface to a copy sheet. Toner particles on the copy sheet are heated to permanently affix the powder image to the copy sheet.

In a high speed commercial printing machine of the foregoing type, large volumes of copy sheets are feed from at least one sheet feeding tray. The copy sheets are conveyed to a registration transport which positions the sheets for a correct top-to-bottom registration before moving the sheets into contact with the toner powder image on the photoconductive surface. A reflective photosensor located on the edge of the registration transport detects the presence of a copy sheet. An output signal from the sensor informs the machine control logic that a lead edge of the copy sheet has arrived at the sensor and is ready to register with the image on the photoconductive member. The control logic continues to monitor the sensor to determine the passage of both the lead and the trail edge of the copy sheet as it moves through the registration transport. A sheet jam is indicated when the sensor detects the lead edge, but fails to detect the passage of the trail edge within a selected time interval. Thus, jam detection is a function of lead and trail edge detection or the absence and presence of the sheet.

Copy sheets having punched holes or other features such as notches, trimmed corners, or windows positioned near the top of the sheet cause a registration sensor fault code to occur. When any of these irregularities are detected after the lead edge of one copy sheet, the sensor indicates the absence of the sheet and the controller indicates that the trail edge has been detected, followed by the lead edge of the next sheet. Consequently, a fault code erroneously indicates that a new copy sheet arrived at the registration transport sensor prematurely after the machine control logic generated a registration synchronization signal, indicating that the new sheet could not be registered correctly. Clearly, it would be highly desirable to have a registration sensor that ignores holes or other other missing parts of the copy sheet which are smaller than the sheet length.

Various approaches have been devised for detecting the arrival of a copy sheet on a registration transport which will be positioned to register with the image on the photoconductive member. The following disclosure appears to be relevant:

U.S. Pat. No. 4,874,958

Patentee: Sampath et al.

Issued: Oct. 17, 1989

The relevant portion of the foregoing patent may be briefly summarized as follows:

U.S. Pat. No. 4,874,958 describes an apparatus for determining the location of and the edge of an advancing sheet. The apparatus also discriminates the presence of a hole on the sheet. A single sensor composed of a light emitting diode and a photodiode detector are arranged to cooperate with corresponding control logic to sense the lead edge of a sheet. When the lead edge is detected, the control logic blocks the sensor signal until the trailing edge of the sheet is moved a first predetermined distance past the sensor. As the sheet moves through the first predetermined distance, the sensor signal is unblocked to continuously monitor the sensor. When a space, which may be either a hole or a trailing edge, is detected, the sensor is monitored again as the sheet moves past a second predetermined distance. If, as the sheet is moving through the second predetermined distance, a space, such as the continuous absence of the sheet, is detected, then the trailing edge of the sheet has been sensed. Alternatively, if the sheet is detected rather than a space, then a hole has been detected and the process is repeated, such that the sensor is monitored continuously through the movement of another predetermined distance. When the trailing edge of the sheet is finally detected, the control logic, actuates a signal for subsequent processing of the sheet.

Pursuant to the features of the present invention, there is provided an apparatus for detecting a leading edge or a trailing edge of a moving sheet. The apparatus includes an elongated light source extending in a direction substantially parallel to the direction of the moving sheet. A plurality of sensors are arranged in an array extending in a direction substantially parallel to the elongated light source. The sensors are in a receiving relationship with the light source. The elongated light source and the plurality of sensors define a passageway through which the moving sheet passes.

In accordance with another aspect of the present invention, there is provided an electrophotographic printing machine of the type in which a leading edge and a trailing edge of a moving sheet are detected. The improvement includes an elongated light source extending in a direction substantially parallel to the direction of the moving sheet. A plurality of sensors are arranged in an array extending in a direction substantially parallel to the elongated light source. The sensors are in a receiving relationship with the light source. The elongated light source and the plurality of sensors define a passageway through which the moving sheet passes.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents that may be included within the spirit and scope of the invention as defined by the appended claims.

Figure 7:
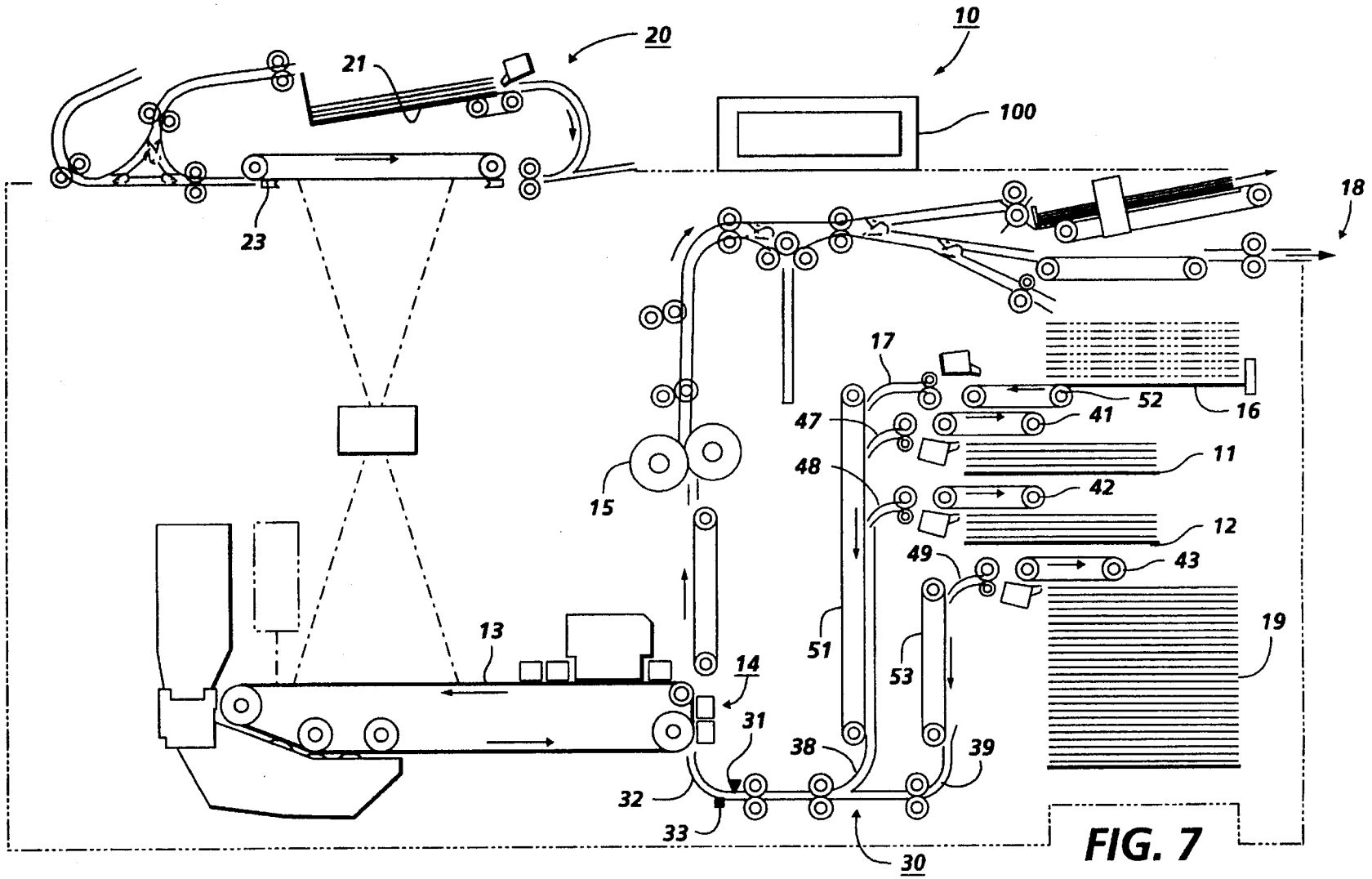
FIG. 7 is a schematic, elevational view depicting an illustrative electrophotographic printing machine.

For a general understanding of the features of the present invention, reference is made to the drawings. In the drawings, like reference numerals have been used throughout to designate identical elements. FIG. 7 schematically depicts the various elements of an illustrative electrophotographic printing machine. It will become evident from the following discussion that features of the present invention are not specifically limited in their application to the particular printing machine depicted herein, but may be used in any suitable printing machine wherein a registration transport is employed.

Referring now to FIG. 7 of the drawings, the printing machine and its operation will be described with reference thereto. Inasmuch as the art of electrophotographic printing is well known, the operation of the printing machine will be described briefly hereinafter.

The electrophotographic printing machine, generally designated by the reference numeral 10, is shown reproducing copies of original documents advanced by a document feeder, indicated generally by the referenced numeral 20. Document feeder 20 is shown positioned above a platen at the imaging station of printing machine 10. Document feeder 20 provides for automatically feeding or transporting individually registered and spaced documents onto and over the platen 23 of copier 10. Document feeder 20 has the conventional "racetrack" document loop path configuration, and preferably has generally known inverting and noninverting return circulation paths to loading and restacking tray 21.

With continued reference to FIG. 7, electrophotographic printing machine 10 includes a belt 13 having a photoconductive surface deposited on a conductive substrate. The belt advances successive portions of the photoconductive surface to various processing stations disposed about the path of movement thereof. At the charging station, a corona generating device charges the photoconductive surface of the belt to a relatively, high, substantially uniform potential. Thereafter, the charged portion of the photoconductive surface is advanced through the imaging station. At the imaging station, a flash lamp illuminates the original document on platen 23. The light rays reflected from the original document are transmitted through the lens forming a light image thereof. These light rays are focused onto the charged portion of the photoconductive surface to selectively dissipate the charge thereon. This records an electrostatic latent image on the photoconductive surface which corresponds to the informational areas contained within the original document disposed upon the platen.

One skilled in the art will appreciate that a Raster Input Scanner (RIS) and a Raster Output Scanner (ROS) may be used instead of the light lens system heretofore described. The RIS contains document illumination lamps, optics, a mechanical scanning mechanism and photosensing elements such as charged couple device (CCD) arrays. The RIS captures the entire image from the original document and converts it to a series of raster scan lines. These raster scan lines are an output of the RIS and function as the input to the ROS. The ROS performs the function of creating the output copy of the image and lays out the image in a series of horizontal lines with each line having a specific number of pixels per inch. These lines illuminate the charged portion of the photoconductive surface to selectively discharge the charge thereon. An exemplary ROS has lasers with rotating polygon mirror blocks, solid state modulator bars and mirrors. Still another type of exposure system would merely utilize a ROS with the ROS being controlled by the output from an electronic subsystem (ESS) which prepares and manages the image data flow between a computer and the ROS. The ESS is the control electronics for the ROS and may be a self-contained, dedicated minicomputer.

After the electrostatic latent image is recorded on the photoconductive surface, the belt advances it through a development station. At the development station, a magnetic brush development system transports a developer material of carrier granules and toner particles into contact with the electrostatic latent image recorded on the photoconductive surface. The toner particles are attracted from the carrier granules to the electrostatic latent image forming a developed image or a toner powder image on the photoconductive surface of the belt.

After development, the belt advances the developed image to the transfer station. At the image transfer station, a copy sheet is moved into contact with the toner powder image. A corona generating device sprays ions onto the backside of the copy sheet. This attracts the toner powder image from the photoconductive surface to the copy sheet.

After transfer, the copy sheet moves to the fusing station. The fusing station includes a fuser assembly which permanently affixes the transferred toner powder image to the copy sheet. By way of example, the fuser assembly includes a heated fuser roll and back-up roll. The copy sheet passes between the fuser roll and back-up roll with the toner powder image contacting the fuser roll. In this manner, the toner powder image is permanently affixed to the copy sheet.

After fusing, a conveyor belt guides the advancing sheet to a catch tray or to a finishing station wherein a plurality of sets may be formed with the copy sheets being either stapled or bound to one another.

Blank or clean copy sheets can be conventionally fed from tray 11 or tray 12, or a high capacity tray 19 thereunder, to a registration transport 30 where the sheet is registered side-to-side. The speed of the copy sheet is also adjusted at the registration transport 30 so that the sheet arrives at the image transfer station 14 in synchronization with the image on the surface of the photoconductive belt. The registration transport 30 receives a copy sheet from either a vertical transport 51 or a high capacity tray transport 53 and moves the received sheet to a pretransfer baffle 32. A duplex tray 16 collects and temporarily stacks documents therein when 2-sided copies are selected. The vertical transport 51 receives the sheet from either tray 11 or tray 12, or the 1-sided copy from duplex tray 16, and guides it to the registration transport 30 via a turn baffle 38. A sheet feeder 52 advances the stacked sheets from duplex tray 16 to the vertical transport 51 by a path 17. In a similar fashion, sheet feeders 41 and 42 respectively advance copy sheets from trays 11 and 12 to the vertical transport 51 by paths 47 and 48. The high capacity tray transport 53 receives the sheet from tray 19 and guides it to the registration transport 30 via a lower baffle 39. A sheet feeder 43 advances copy sheets from tray 19 to transport 53 by a path 49. A registration sensor 31 is located on the edge of the registration transport 30. When the sensor 31 detects a sheet, an output is sent to a programmable controller 100. The output from sensor 31 is used for the following purposes: to inform the machine control logic when the lead edge of the paper arrives at the sensor and is ready to register with the image on the surface of the photoconductive belt; to monitor the lead edge and the trail edge of the sheet for jam detection, as the sheet moves through the registration transport; to perform a dynamic sheet width measurement; and to verify when a transparency has been fed. Further details of registration transport 30 will be discussed with reference to FIG. 2 through FIG. 4.

The pretransfer baffle 32 guides the sheet from the registration transport 30 to the image transfer station 14. Pretransfer baffle 32 is isolated from machine ground to prevent the discharge of the photoconductive belt. A charge limiter 33 is located on the pretransfer baffle 32. Charge limiter 33 restricts the amount of electrostatic charge that the sheet can place on the pretransfer baffle 32, which may cause an image quality problem and shock hazard to the operator. The charge can be placed on the baffle from either the movement of the sheet through the baffle or by the corona generating device located at the transfer station. When the charge exceeds a threshold limit, the charge limiter 33 discharges the excess to ground.

During duplex operation, the sheet fed from duplex tray 16 receives an image on the second side thereof, at transfer station 14, in the same manner as the image was deposited on the first side thereof. The completed duplex copy exits to a finishing and stacking module via output 18.

All printing machine document feeder and finishing operations are preferably controlled by programmable controller 100. A suitably known programmable microprocessor system is described in U.S. Pat. No. 4,475,156, the relevant portion thereof being hereby incorporated into the present application. The controller 100 controls all of the machine functions described herein including all sheet feeding. A known touch screen type of operator input control and display is utilized in conjunction with controller 100.

Figure 1:
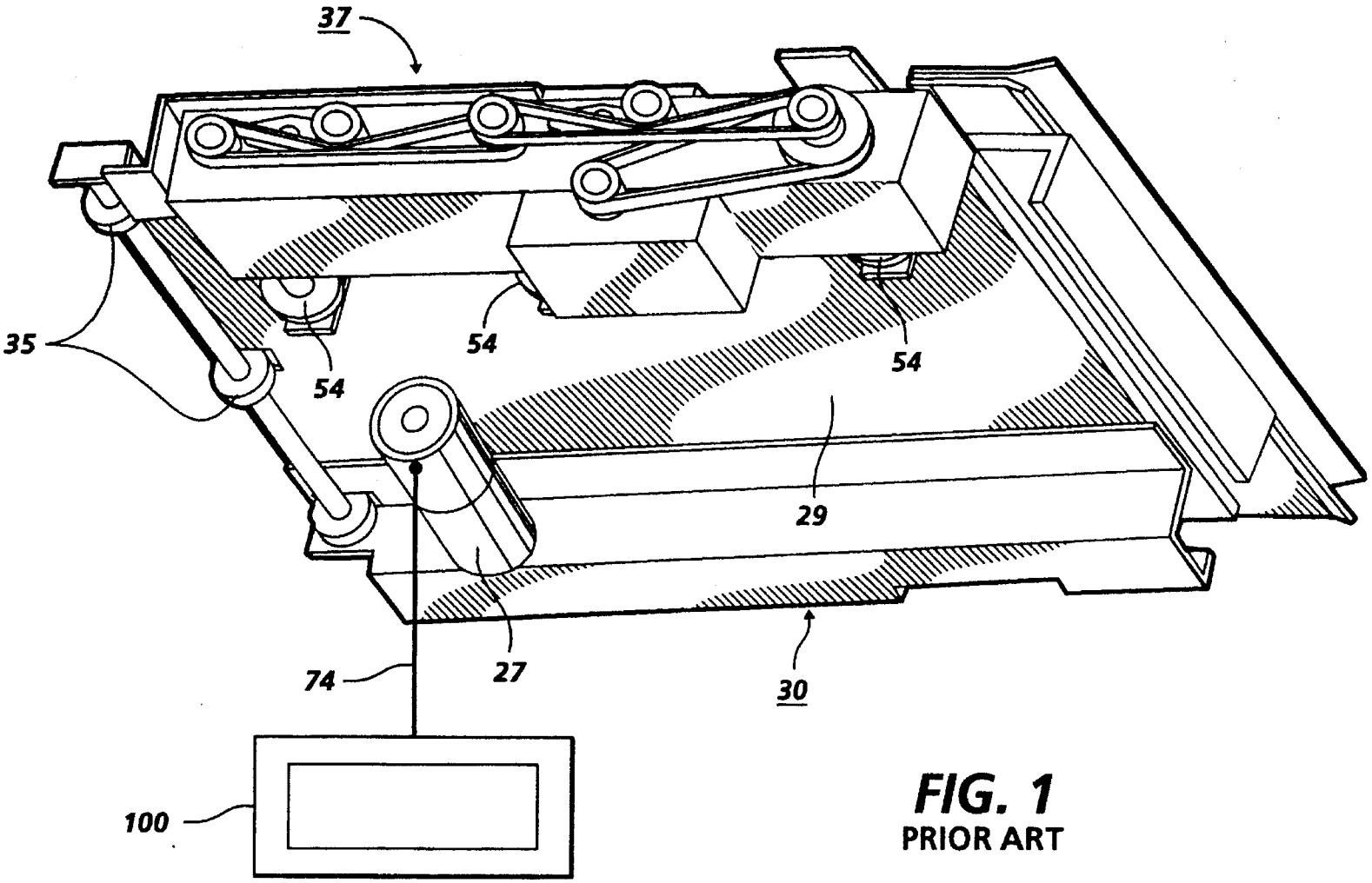
FIG. 1 PRIOR ART
FIG. 1 is a perspective view showing the bottom of an illustrative prior art registration transport device.
Figure 2:
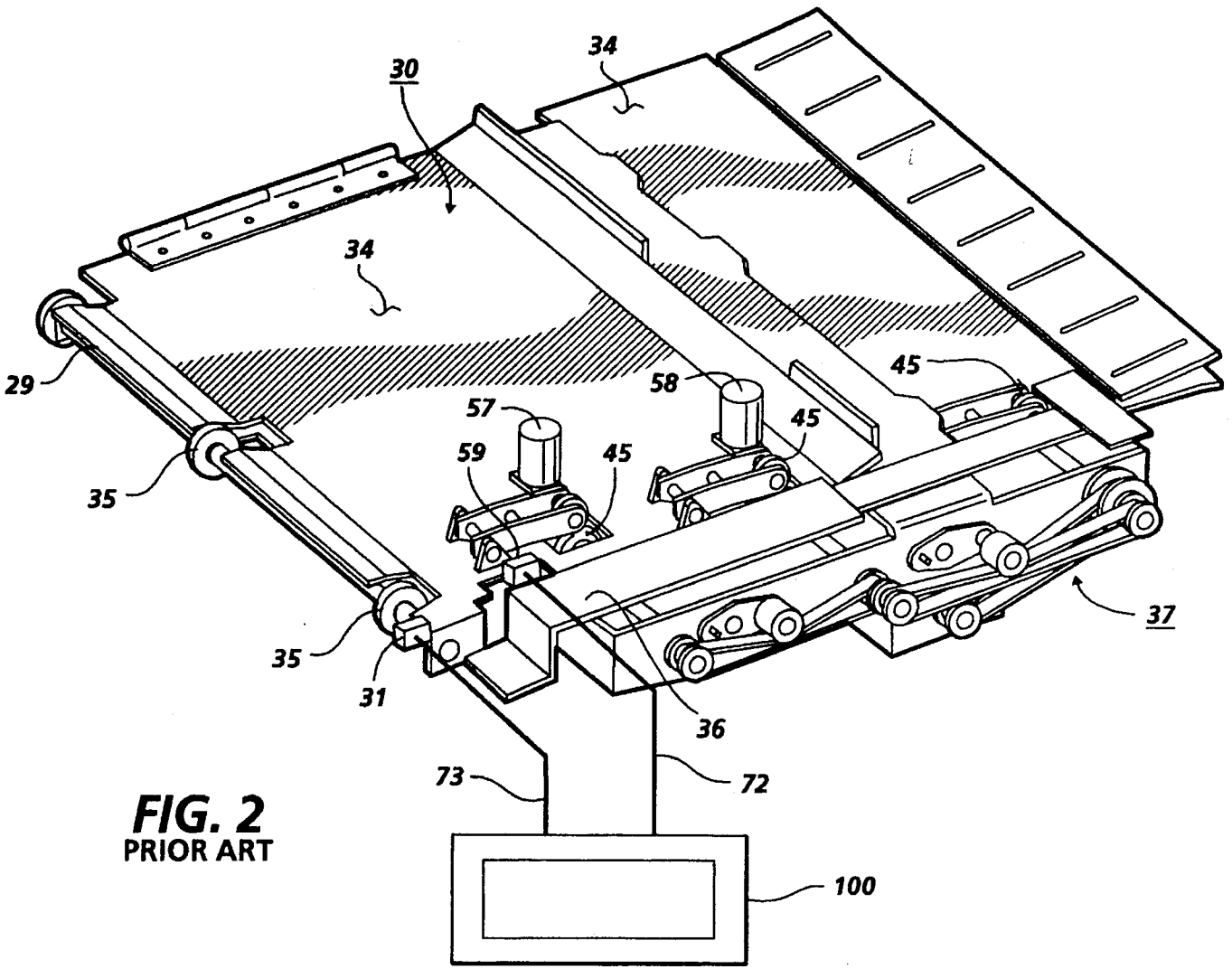
FIG. 2 PRIOR ART
FIG. 2 is a perspective view showing the top of an illustrative prior art registration transport device.
Figure 3:
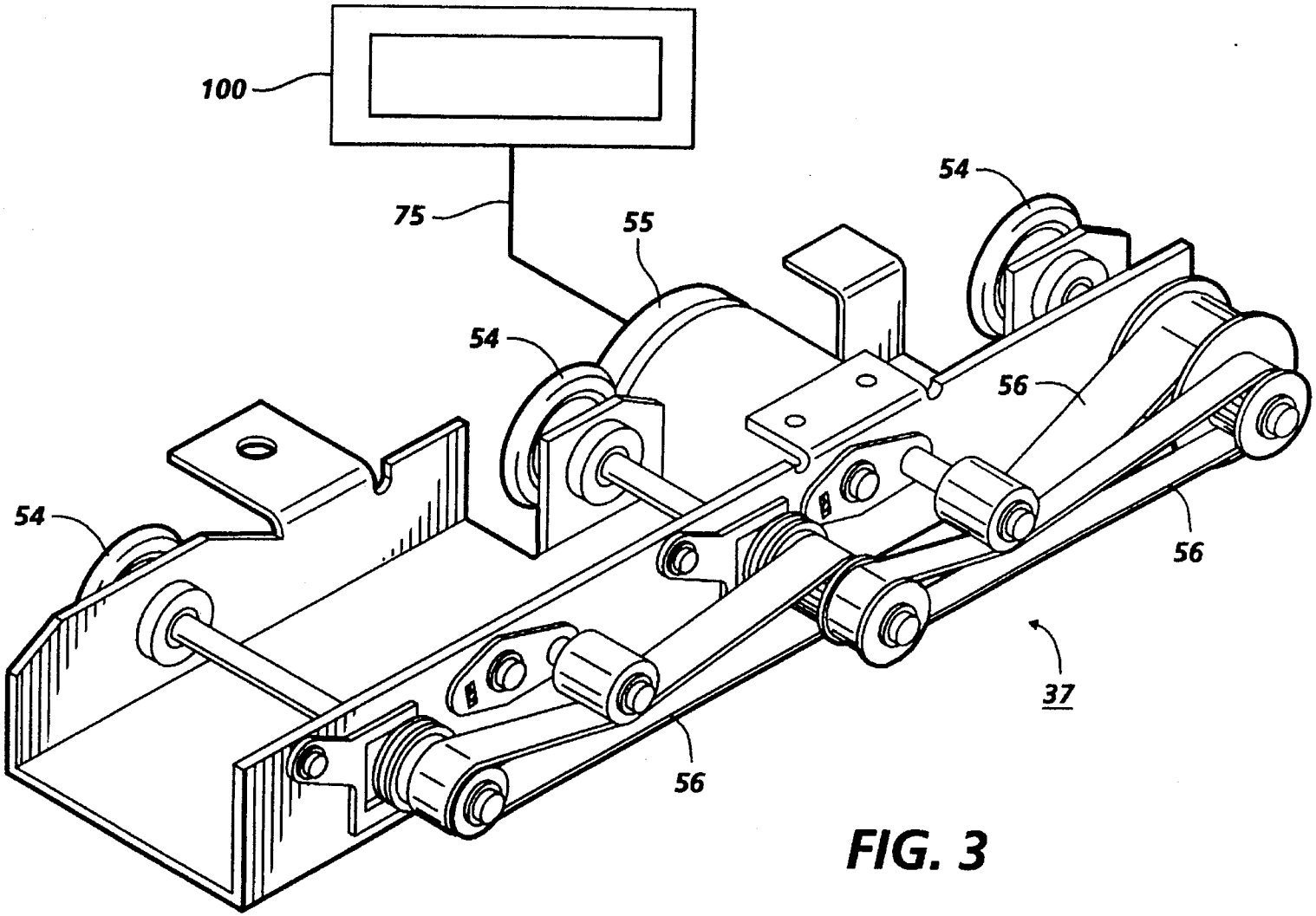
FIG. 3 is a fragmentary, perspective view of the registration cross rolls drive assembly used in the FIG. 3 registration transport.

Turning now to FIG. 1 through FIG. 3, there is shown further details of the prior art registration transport 30. FIG. 1 is a perspective view of the bottom of registration transport 30, while FIG. 2 is a perspective view of the top thereof. FIG. 3 is an exploded view of a cross rolls drive assembly 37 located at the front of the registration transport 30 shown in FIG. 1 and FIG. 2. Referring to FIG. 2, the registration transport 30 includes a lower transport 29, upper baffles 34, and a registration edge 36. The upper baffles are shown in the closed position, which is the normal position for operation. The registration transport 30 receives a copy sheet from either the vertical transport or the high capacity transport and moves it to the pretransfer area. Cross rolls drive assembly 37 moves the sheet across the lower transport 29 and positions it against registration edge 36 to ensure the correct top-to-bottom registration of the sheet. Referring to FIG. 3, a plurality of cross rolls 54 are driven by an AC motor 55. When the printing machine START button is pressed, the machine controller 100 switches on the cross rolls motor 55 via conductor 75 at cycle up and continues until cycle down. The cross rolls motor 55 drives a plurality of cross rolls drive belts 56 which, in turn, provide drives to the cross rolls 54. A plurality of cross roll idlers 45, located on the upper baffles 34, of FIG. 2 ensure that the proper drive is applied to the copy sheet.

Returning to FIG. 2, the cross rolls 54 are angled toward the registration edge 36 on the front of registration transport 30. When a copy sheet enters the the cross roll nip, it is driven against the registration edge 36 and moved towards a plurality of registration servo drive rolls 35. A left cross roll solenoid 57 and a right cross roll solenoid 58 are located on one of the upper baffles 34. When energized, solenoids 57 and 58 raise the cross roll idlers 45 from the cross rolls 54 in order to prevent trail edge damage to the copy sheet. One or both solenoids 57 and 58 energize after a cross rolls sensor 59 detects the lead edge of the copy sheet. If the sheet is less than 300 millimeters wide, for example, only the left solenoid 57 energizes. If the sheet is more than 300 millimeters wide, both solenoids 57 and 58 energize. If a copy sheet is not detected by the cross roll sensor 59, a fault code is recorded by the machine controller 100. As the copy sheet is moved across the lower transport 29, solenoids 57 and 58 deenergize when the registration sensor 31 detects the copy sheet. If the sheet is less than 300 millimeters wide, the left cross roll solenoid 57 is deenergizes after the registration sensor 31 detects the lead edge of the copy sheet. Conversely, if the sheet width is greater than 300 millimeters, both the left cross roll solenoid 57 and the right cross roll solenoid 58 deenergize after the registration sensor 31 detects the lead edge of the copy sheet.

When the registration sensor 31 detects a copy sheet, an output is sent via a conductor 72 to controller 100 to inform controller 100 that the lead edge of the copy sheet arrived at sensor 31 and is ready to register with the image on the photoconductive member. Referring to FIG. 1, controller 100 sends a signal via conductor 74 to a registration servo motor/encoder assembly 27, located on the underside of the lower transport 29. The registration servo motor/encoder assembly 27 ensures that both the copy sheet and the image on the photoconductive member arrive at the image transfer station at the same time. The motor portion of assembly 27 is a variable speed motor that drives a pair of registration drive rolls 35 to move the copy sheet to the image transfer station. The encoder portion of assembly 27 monitors the speed of the motor and generates a series of servo clock pulses which are used to obtain a phase lock with a single machine clock pulse generated by controller 100. The machine clock pulse is synchronized to the rotational speed of the photoconductive member. For every revolution of the photoconductive member, one machine clock pulse is generated by controller 100. Depending upon the phase difference between the machine clock pulse and the servo clock pulses, the speed of the motor is increased or decreased so that the copy sheet arrives at the image transfer station at the same time as the image on the photoconductive member.

A problem associated with the single registration sensor 31 shown in FIG. 7 and FIG. 2 is the occurrence of a registration sensor fault code when copy sheet irregularities are detected after the lead edge. In the system discussed with reference to FIG. 7 and FIG. 2 and FIG. 3, copy sheet irregularities are treated like a corresponding trail edge, followed by the lead edge of the next copy sheet. Consequently, the fault code erroneously indicates that a new copy sheet arrived at the registration transport sensor prematurely after the machine control logic generated a registration synchronization signal, indicating that the new sheet could not be registered correctly. A preferred embodiment of a linear array sensor, which may be utilized in conjunction with the present invention ignores irregularities on the copy sheet that are smaller than the sensor array.

Figure 4:
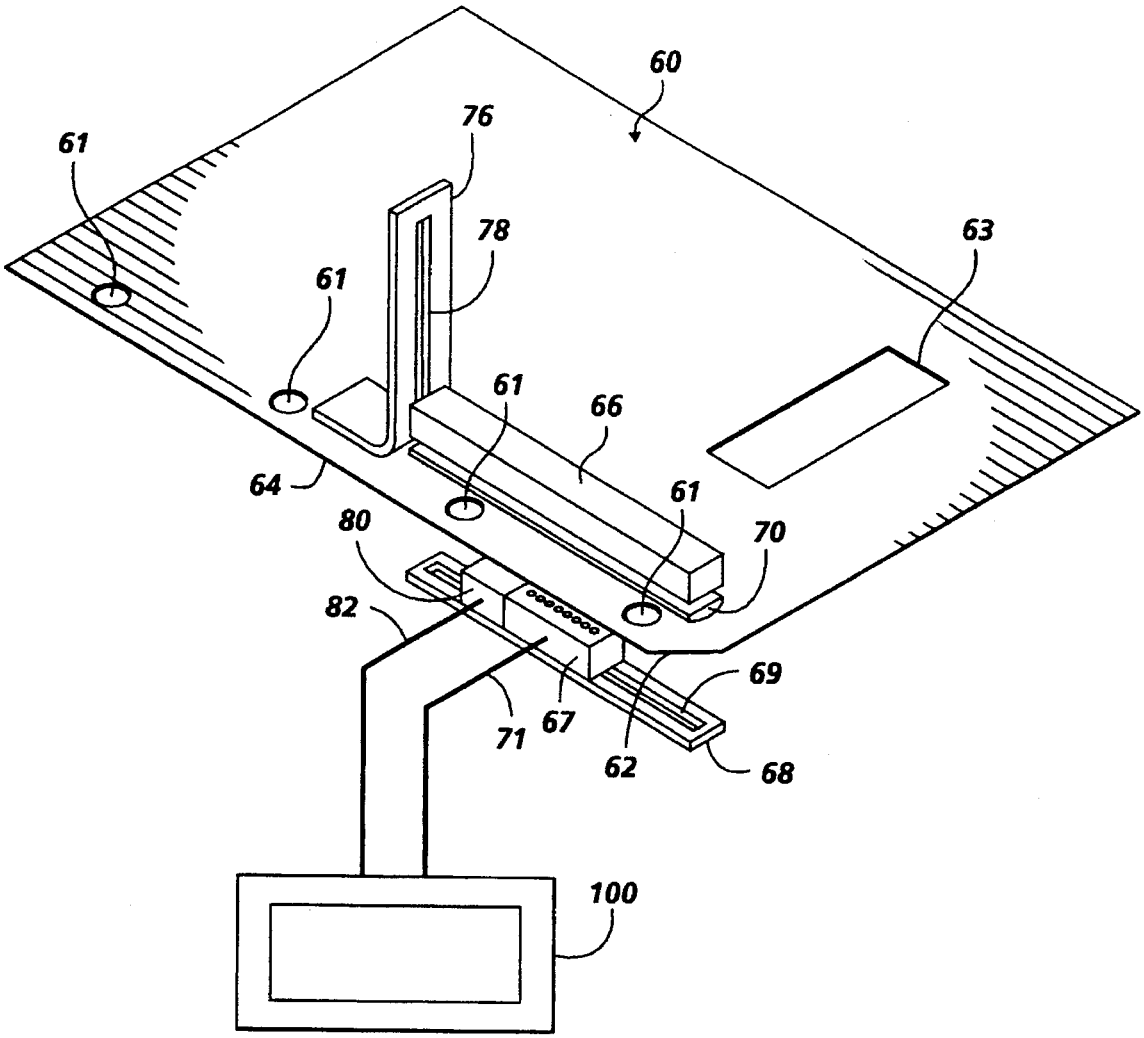
FIG. 4 is a schematic, elevational view of a preferred embodiment of a linear array sensor for copy sheet registration in accordance with the present invention.

Referring now to FIG. 4, there is shown schematically, a linear array sensor for detecting the lead and trail edges of a copy sheet 60 having irregularities thereon. The copy sheet irregularities may include customized prepunched holes 61, a trimmed corner 62, and a window 63. The sensor array arrangement includes an extended light source 66 and a photodetector 67. Light source 66 is a low wattage tungsten illuminator, which is approximately 150 millimeters in length. Alternatively, the light source 66 may comprise other light sources such as, for example, an array of light emitting diodes (LED's), laser diodes, or a small fluorescent lamp. The photodetector 67 is a charge coupled device (CCD) array employing digital logic elements therein to signal controller 100 via conductor 71 of the presence or absence of any copy sheet. Photodetector 67 is approximately 12 to 50 millimeters in length. A longer length CCD array allows for additional elements to detect larger irregularities on the copy sheet. The photoconductor 67 is mounted to a horizontal plate 68 having a slot 69 for positioning the photodetector 67 between the left and right ends of the mounting plate 68. An adjustment range of approximately 75 millimeters, in length, between the left and right ends of the mounting plate 68 is sufficient to avoid irregular features likely to be detected on a customized copy sheet. The light source 66 radiates light energy to cover the entire adjustment range. A semi-cylindrical lens 70, approximately 150 millimeters in length, is located in front of the output portion of the light source 66. It ensures that the detector 67 receives a good signal by focusing the emitted light onto photodetector 67. Light source 66 and lens 70 are mounted to a vertical mounting plate 76 having a slot 78 for positioning them between the top and bottom ends of the mounting plate 78. An adjustment height of approximately 25 millimeters, in height on slot 78, is sufficient to focus the emitted light onto photodetector 67. A digital to analog converter (DAC) output 80 on photodetector 67 is used to calibrate the spatial alignment between the light source 66 and the photodetector 67. Light source 66 is moved through its adjustment range on mounting plate 76. The corresponding output of light energy is monitored at the DAC 80 output. When the light energy signal received at the photodetector 67 reaches a peak amplitude, for each element in the array, the light source 66 and the photodetector 67 are spatially aligned. The individual voltage outputs of photodetector 67 are summed by the DAC 80 and communicated to controller 100 via conductor 82 as a calibrated reference point above or below a predetermined level. Both the light source 66 and the photodetector 67 are parallel to a lead edge of copy sheet 60. Light source 66 is located above the copy sheet 60 and the photodetector 67 is located below it. In operation, the larger copy sheet irregularities such as, for example, the window 63 or the clipped corner 62 will present a false lead or trail edge indication to controller 100 if the irregularity is bigger than the photodetector 67. For this reason, a Customer Service Engineer (CSE) will adjust the horizontal position of the photodetector array 67, at a printing machine site, to suit a customer's particular application for feeding customized copy sheets and leave it in that position to avoid further alignment problems. For example, if the customer is running window copy sheet stock as a cover to a bound book, a CSE would adjust the horizontal position of photodetector 67 so that when any of the elements in the photodetector array are covered by the copy sheet 60 (no light), the photodetector 67 signals the controller 100 via conductor 71, that a copy sheet was present. Conversely, when all the elements of the photodetector 67 are uncovered (light), the photodetector 67 sends an opposite sense to controller 100 to indicate that the copy sheet is not present. Thus, the photodetector 67 ignores the window and other missing parts of the copy sheet that are smaller than the array.

Figure 5:
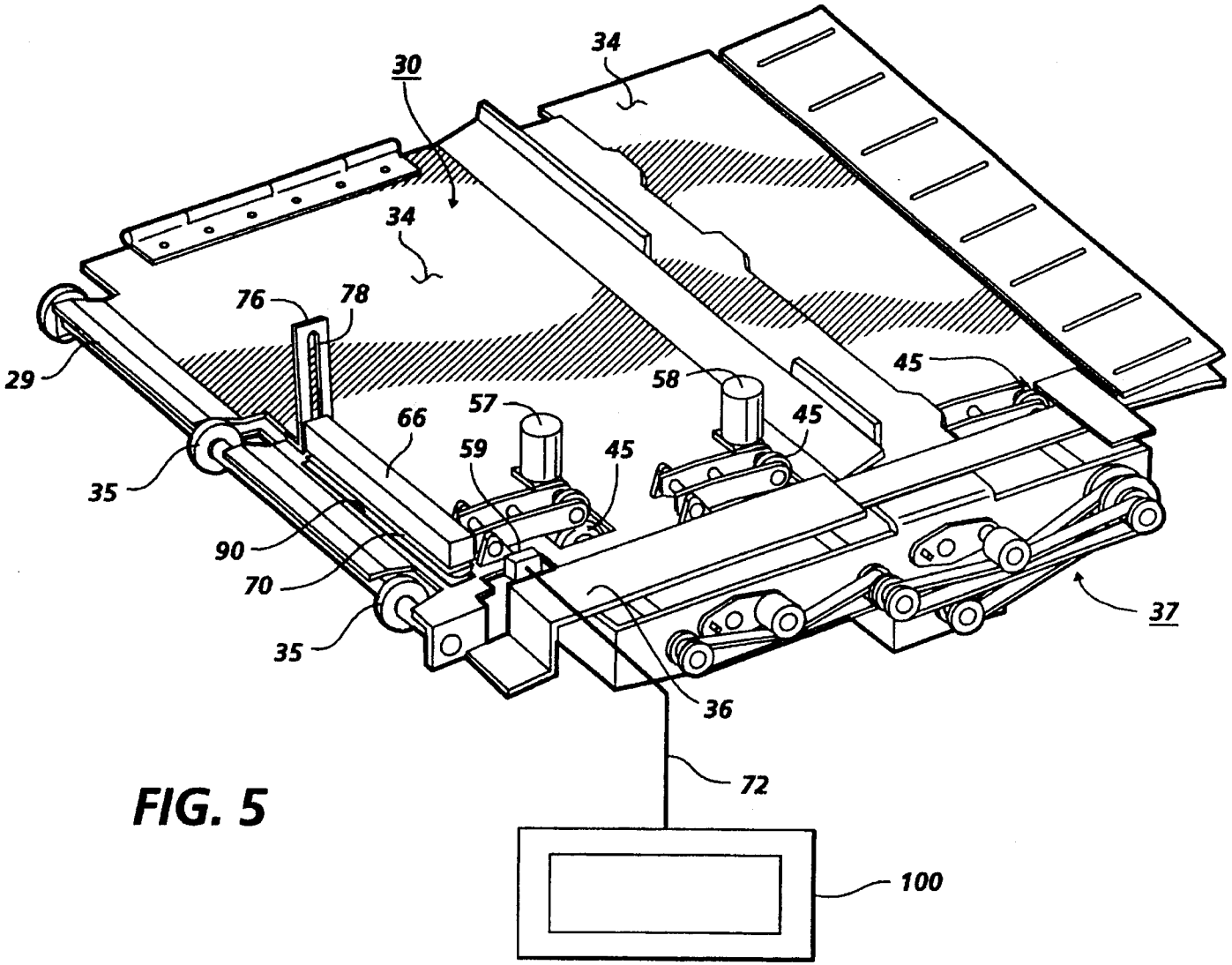
FIG. 5 is a perspective view showing the top of an illustrative registration transport device having the linear array sensor for copy sheet registration incorporated therein.
Figure 6:
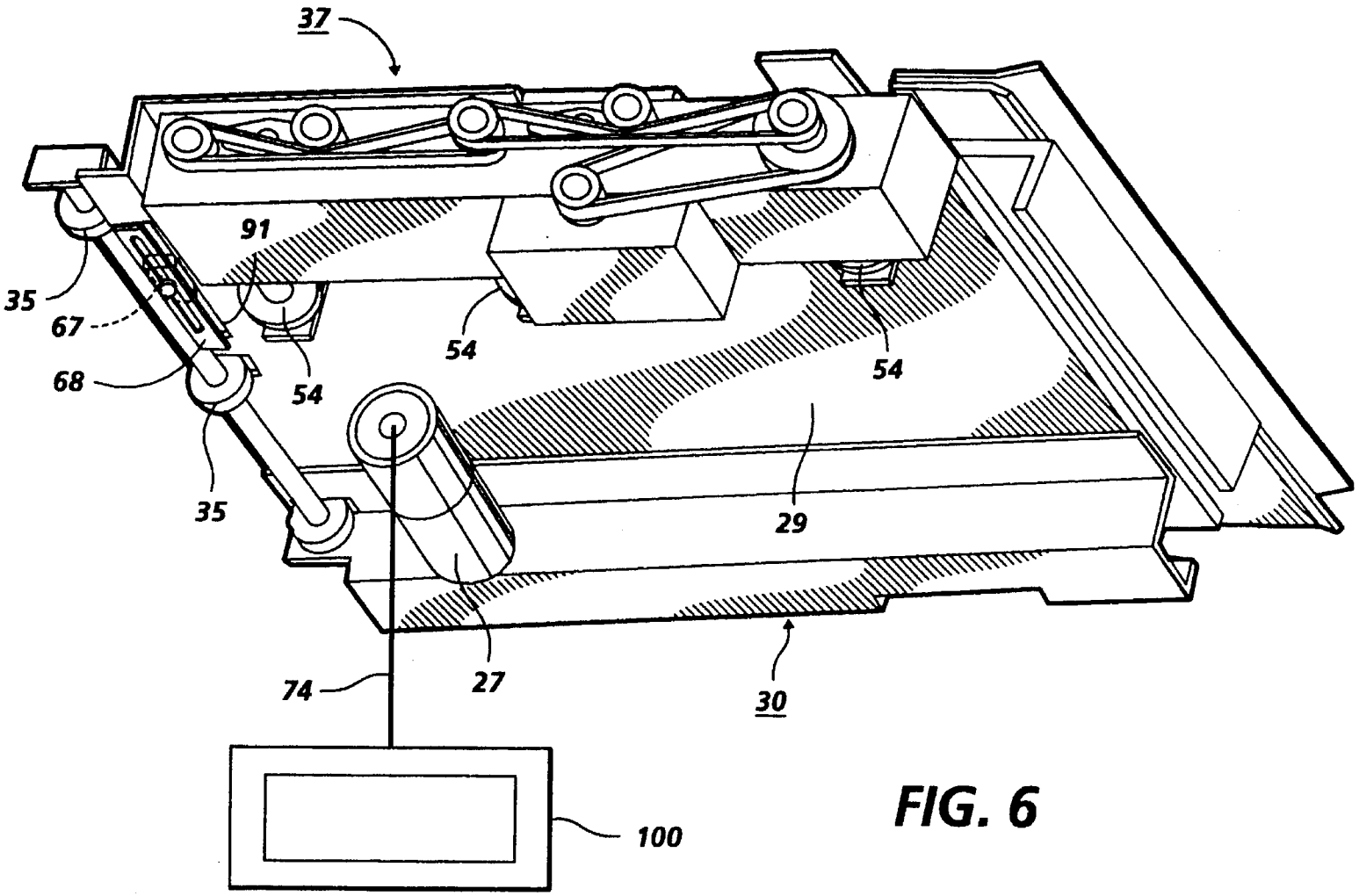
FIG. 6 is a perspective view showing the bottom of an illustrative registration transport device having the linear array sensor for copy sheet registration incorporated therein.

Referring further to FIG. 5 and FIG. 6 to illustrate the placement of the invention in a printing machine, FIG. 5 shows the assembly comprising light source 66 and semi-cylindrical lens 70 positioned on the vertical mounting plate 76. The vertical mounting plate 76 is mounted to one of the upper baffles 34 and located opposite the registration edge 36 on the front of registration transport 30. A cut-out 90 in the upper baffle 34 allows emitted light from light source 66 to pass through the baffle 34 to lower transport 29. In FIG. 6, a cut-out 91 in the lower transport 29 allows the light emitted from light source 66 to pass through the lower transport 29 and strike the photodetector array 67. The mounting plate 68, on which photodetector array 67 is mounted, is attached to a side member (not shown) of the registration transport 30.

Referring again to FIG. 5, the operation of the registration transport 30, installed with the linear array sensor of the present invention is described. When a customized copy sheet having irregularities thereon enters the the cross roll nip, it is driven against the registration edge 36 and moved towards the plurality of registration servo drive rolls 35. Cross roll solenoids 57 and 58 energize so as to raise the cross roll idlers 45 from the cross rolls 54 to prevent trail edge damage to the copy sheet. One or both cross roll solenoids 57 and 58 are energized as the cross rolls sensor 59 detects the lead edge of the copy sheet. If the sheet is less than 300 millimeters wide only the left solenoid 57 energizes. If the sheet is more than 300 millimeters wide, both solenoids 57 and 58 are energized. If a copy sheet is not detected by the cross roll sensor 59, a fault code is recorded by the machine controller 100. As the copy sheet moves across the lower transport 29, solenoids 57 and 58 deenergize when photodetector 67 detects the copy sheet. The individual elements of photodetector 67, sourced by light source 66, are scanned by controller 100 until any one of the elements indicates, by a logic output corresponding to the absence of light, that the lead edge of the copy sheet is actually present. If the sheet is less than 300 millimeters wide, the left cross roll solenoid 57 is deenergized. Conversely, if the sheet width is greater than 300 millimeters, both cross roll solenoids 57 and 58 are deenergized. When the photodetector 67 detects an irregular copy sheet, an output is sent via a conductor 72 to controller 100 to inform controller 100 that the lead edge of the copy sheet arrived at photodetector 67 and is ready to register with the image on the photoconductive member.

In recapitulation, it is clear that the linear array registration sensor of the present invention has an extended light source and a photodetector respectively mounted above and below a registration transport. A copy sheet moves through the transport to be registered with the image on a photoconductive member. Individual elements, in the sensor array, scan across the copy sheet to find the lead edge of the copy sheet. Irregular features in the copy sheet, such as holes or other missing parts positioned near the top of the copy sheet, are ignored to prevent an erroneous indication of the lead or trail edge of the copy sheet.

It is, therefore, evident that there has been provided, in accordance with the present invention, a linear array sensor for copy sheet registration having a light source and a photodiode that fully satisfies the aims and advantages of the invention as hereinbefore set forth. While the invention has been described in conjunction with a preferred embodiment thereof, it is evident that many alternatives, modifications, and variations may be apparent to those skilled in the art. Accordingly, it is intended to embrace all such alternatives, modifications, and variations which may fall within the spirit and broad scope of the appended claims.

I claim:

1. An apparatus for detecting a leading edge or a trailing edge of a moving sheet, including:

an elongated light source extending in a direction substantially parallel to the direction of the moving sheet;

a plurality of sensors arranged in an array extending in a direction substantially parallel to said elongated light source in a receiving relationship therewith, said elongated light source and said plurality of sensors defining a passageway through which the moving sheet passes;

a controller, said plurality of sensors transmitting a signal to said controller, said controller, responsive to the signal from said plurality of sensors, indicating the leading edge or trailing edge of the moving sheet; and means associated with said plurality of sensors, for generating a calibration reference signal and transmitting the reference signal to said controller to callibrate said controller.

2. An apparatus according to claim 1, wherein said light source is a length greater than that of an irregularity in the moving sheet.

3. An apparatus according to claim 1, further including a lens, interposed between said elongated light source and said plurality of sensors to focus lights rays emitted from said elongated light source on said plurality of sensors.

4. An apparatus for detecting a leading edge or a trailing edge of a moving sheet, including:

an elongated light source extending in a direction substantially parallel to the direction of the moving sheet;

a plurality of sensors arranged in an array extending in a direction substantially parallel to said elongated light source in a light receiving relationship therewith, said elongated light source and said plurality of sensors defining a passageway through which the moving sheet passes; and a support having said elongated light source mounted movably thereon so as to position said light source relative to said plurality of light sensors.

5. An apparatus according to claim 4, further including a second support having said plurality of light sensors mounted movably thereon.

6. An apparatus according to claim 5, wherein:

said elongated light source is movable on said support in a direction substantially transverse to the moving sheet; and said plurality of light sensors is movable on said second support in a direction substantially parallel to the moving sheet.

7. A printing machine of the type in which a leading edge or a trailing edge of a moving sheet are detected, wherein the improvement includes:

an elongated light source extending in a direction substantially parallel to the direction of the moving sheet;

a plurality of sensors arranged in an array extending in a direction substantially parallel to said elongated light source in a receiving relationship therewith, said elongated light source and said plurality of sensors defining a passageway through which the moving sheet passes;

a controller, said plurality of sensors transmitting a signal to said controller, said controller, responsive to the signal from said plurality of sensors, indicating the leading edge or trailing edge of the moving sheet; and means associated with said plurality of sensors, for generating a calibration reference signal and transmitting the reference signal to said controller to calibrate said controller.

8. A printing machine according to claim 7, wherein said light source is a length greater than that of an irregularity in the moving sheet.

9. A printing machine according to claim 7, further including a lens, interposed between said elongated light source and said plurality of sensors to focus lights rays emitted from said elongated light source on said plurality of sensors.

10. A printing machine of type in which a leading edge ortrailing edge of a moving sheet are detected, wherein the improvement includes:

an elongated light source extending in a direction substantially parallel to the direction of the moving sheet;

a plurality of sensors arranged in an array extending in a direction substantially parallel to said elongated light source in light receiving relationship therewith, said elongated light source and said plurality of sensors defining a passageway through which the moving sheet passes; and a support having said elongated light source mounted movably thereon so as to position said light source relative to said plurality of light sensors.

11. A printing machine according to claim 10, further including a second support having said plurality of light sensors mounted movably thereon.

12. A printing machine according to claim 11, wherein:

said elongated light source is movable on said support in a direction substantially transverse to the moving sheet; and said plurality of light sensors is movable on said second support in a direction substantially parallel to the moving sheet.

* * * * *